US006327731B2

(12) United States Patent
Back et al.

(10) Patent No.: US 6,327,731 B2
(45) Date of Patent: Dec. 11, 2001

(54) CLOTHES WASHER AND DRYER SYSTEM FOR RECYCLING AND REUSING GRAYWATER

(75) Inventors: Dwight D. Back, Melbourne; Robert P. Scaringe, Rockledge; Gregory S. Cole, Ormond Beach, all of FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 09/874,264

(22) Filed: Jun. 6, 2001

Related U.S. Application Data

(62) Division of application No. 09/157,956, filed on Sep. 22, 1998.

(51) Int. Cl.[7] ..... D06F 39/07

(52) U.S. Cl. ..... 8/158; 8/159; 68/902; 68/207; 68/18 F

(58) Field of Search ..... 8/158, 159; 68/902, 68/207, 18 R, 12.12, 18 F

(56) References Cited

U.S. PATENT DOCUMENTS

| | | | | |
|---|---|---|---|---|
| 1,548,247 | * | 8/1925 | Bennett . | |
| 1,940,241 | * | 12/1933 | Bovee | 68/902 |
| 2,588,774 | * | 3/1952 | Smith . | |
| 3,772,901 | | 11/1973 | Ferraro . | |
| 4,104,164 | | 8/1978 | Chelton . | |
| 4,145,279 | | 3/1979 | Selby, III . | |
| 4,162,218 | | 7/1979 | McCormick . | |
| 4,204,339 | * | 5/1980 | Muller | 68/20 |
| 4,277,336 | | 7/1981 | Henschel, Jr. . | |
| 4,757,699 | * | 7/1988 | Arreghini et al. | 68/20 |
| 5,059,330 | | 10/1991 | Burkhardt . | |

(List continued on next page.)

OTHER PUBLICATIONS

"Carwashes Need You, Survey Finds", *Water Technology*, Greg Norton, October 1994, p. 79.
"Laundry Detergents, Do Good Things Come In Small Packages?", *Consumer Reports*, Feb. 1995, pp. 92–93.
"Membrane Ultrafiltration to Treat Landry Wastes and Shower Wastes for Water Reuse," Robert B. Grieves, et al., Society of Automotive Engineers, Inc., Intersociety Conference on Environmental Systems, Jul. 29–Aug. 1, 1974, Seattle, Washington, #740924.
"Renovation of Water Shower Water By Membrane Filtration," Daniel S. Lent, Report No. CG–D–25–77, Phase I Interim Report, Nov. 1976, U.S. Army Mobility Equipment Research & Development Command.
"Higher Water, Sewer Rates Fuel Recycling", Ken Leek, *Water Technology*, Apr. 1995, pp. 10–16.
"Washing Machines, What's Ahead? What's in Stores Now?", *Consumer Reports*, Feb. 1995, pp. 96–99.
"Laundry Detergents: Advances," Anita Shaw, Editor in Chief, *Soap/Cosmetics/Chemical Specialties*, Jan. 1995, pp. 22–28.

(List continued on next page.)

*Primary Examiner*—Frankie L. Stinson
(74) *Attorney, Agent, or Firm*—Crowell & Moring LLP

(57) ABSTRACT

A compact, portable clothes washer and dryer system requires no direct water connection or drain line and includes a feed reservoir for holding hot or cold water; a basket for receiving clothes and said water from said feed reservoir; a filtration membrane unit that generates permeate for rinsing said clothes and retentate; a motor for operating said basket; a pump for circulating water from said feed reservoir through said membrane unit and to said basket; and a heating assembly for drying said clothes in said basket. The system reduces water usage and gray water generation for washing clothes. The system is particularly useful in dormitories, small apartments, or other remote dwellings where water is scarce or where there are no water feed lines or drains.

7 Claims, 1 Drawing Sheet

U.S. PATENT DOCUMENTS

| | | | | |
|---|---|---|---|---|
| 5,074,131 | * | 12/1991 | Hirose et al | 68/20 |
| 5,093,012 | | 3/1992 | Bundy et al. . | |
| 5,106,493 | | 4/1992 | McIntosh . | |
| 5,121,615 | * | 6/1992 | Yu | 68/20 |
| 5,147,532 | | 9/1992 | Leek, Jr. . | |
| 5,160,430 | | 11/1992 | Gasser et al. . | |
| 5,160,606 | | 11/1992 | De Simone et al. . | |
| 5,173,180 | | 12/1992 | Stewart et al. . | |
| 5,241,843 | * | 9/1993 | Hein . | |
| 5,243,719 | | 9/1993 | McDonald et al. . | |
| 5,288,412 | | 2/1994 | Voorhees et al. . | |
| 5,317,766 | | 6/1994 | McDonald et al. . | |
| 5,353,448 | | 10/1994 | Lee . | |
| 5,452,956 | | 9/1995 | Gilliam . | |
| 5,498,330 | | 3/1996 | Delle Cave . | |
| 5,503,735 | | 4/1996 | Vinas et al. . | |
| 5,606,878 | * | 3/1997 | Arrghini et al. | 68/20 |
| 5,617,885 | * | 4/1997 | Centis . | |
| 6,195,825 | * | 3/2001 | Jones . | |

OTHER PUBLICATIONS

"Carwashes Reclaim Water, Save Money", Suzanne Stansbury, *Water Technology*, Oct. 1944, pp. 75–77.

"Microbiological Aspects of Water Recycle for Laundry Applications, " J. A. Akkara et al., Report No. NATICK/TR–88/041, U.S. Army Natick RD&E Center, Jan. 25, 1988.

"Development of a Reverse Osmosis Module for Wash Water Recycling in a Space Environment at 165 Degreees F," R. W. Lawrence et al., National Technical Information Service, Jan. 3, 1974, Report No. 0218–F "Design of an Ultrafiltration/Reverse Osmosis Prototype Subsystem for the Treatment of Spacecraft Wastewaters," S. B. McCray et al., SAE Technical Paper Series #951738, 25th International Conference on Environmental Systems, San Diego, California, Jul. 10–13, 1995.

"Reverse Osmosis Treatment of Selected Shipboard Generated Waste Streams," W. L. Adamson et al., #74–ENAs–12, Intersociety Conference on Environmental Systems, Seattle, Washington, Jul. 29–Aug. 1, 1974.

"Treatment of Wastewater from Detergent Production by Means of Membrane Separation," N. A. Bernovskaya et al., Scientific–Research Institute of oil Shales (NIIslantsev). Translated from Khimiya i Tekhnologiya Topliv i Masel, No. 5, pp. 56–58, May 1980.

"A Continuous Shipboard Laundry Wastewater Treatment and Recycling Systems," W. Van Hees et al., No. 77–ENAs–40, Intersociety Conference on Environmental Systems, San Francisco, California, Jul. 11–14, 1977.

"Shipboard Laundry Wastewater Treatment Systems," E. W. Lard et al., No. 76–ENAs–48, Intersociety Conference on Environmental Systems, San Diego, California, Jul. 12–15, 1976.

* cited by examiner

CLOTHES WASHER AND DRYER SYSTEM FOR RECYCLING AND REUSING GRAYWATER

This application is a division of application Ser. No. 09/157,956, filed Sep. 22, 1998.

BACKGROUND AND SUMMARY OF THE INVENTION

Clothes washers generate a considerable quantity of gray water during a normal wash/rinse cycle. Typically, 25 to 45 gallons can be generated in a single load, which amounts to billions of gallons of gray water a week when extrapolated out to 100,000,000 households and 2 or 3 loads of laundry a week. Not only is the gray water generated and sent to the sewer or septic tank, but an equal quantity of fresh water must be supplied to the washing machine. This is a tremendous burden on water treatment facilities, public water suppliers, and the environment.

Another critical issue in clothes washers and dryers is energy costs. The vast majority of electricity costs for clothes washers is in heating water. It is likely that in the near future regulations will be placed on appliance manufacturers to minimize the energy usage of their products. Some steps have been taken, or are currently being taken, by some appliance manufacturers including a trend toward front loading, reduced water clothes washers. These systems still, however, can use up to 10–25 gallons of water per wash/rinse cycle.

Graywater reuse has been a technology area under rapid development during the past 25 years. The treatment and recycle of graywater (e.g., water from clothes washers carwashes, dishwashers, and showers) has been explored and put into limited practice for commercial and military applications. There is no consensus as to the optimum process for all applications, since the treatment and recycle scheme depends strongly on the size of the application, chemical and physical properties of the graywater, and logistic requirements of the operation.

Currently, most graywater recycle applications have been targeted for carwashes and commercial coin laundries, utilizing depth filtration and carbon adsorption. For example, systems have been demonstrated which use sand filters, centrifugal separators, precipitation of surfactants and other organics, and adsorption media. Other graywater reuse strategies such as chemical precipitation and distillation require several chemicals to be inventoried for treatment, and the processes in general are very sensitive to the chemical environment and temperature, sometimes requiring specific detergent formulas. Distillation, evaporation, or precipitation can produce fouling on the interior parts of equipment if not prefiltered or controlled properly, creating a maintenance nightmare. Distillation also consumes a considerable amount of power.

Adsorption and ion exchange could also be use to remove surfactants and organics, however, the inventors have found that the capacity of adsorption media for graywater constituents is limited, so these systems would be large. The water could also be recycled by chemically destroying the surfactants and organics in the graywater, but these processes can produce more toxic by-products, require the handling of hazardous co-reactants such as peroxides or ozone, and are generally energy intensive (e.g., ozone generation or electron beam power).

In light of the Environmental Protection Agency's (EPA) "zero discharge" mandates, domestic water conservation movements, municipal graywater recycle ordinances, and EPA thrusts toward low-water and reduced-detergent washers, graywater recycle strategies are beginning to emerge in limited applications across the country. The general trend of graywater recycling efforts is in the direction of membrane separation, with supporting prefiltration and post-polishing steps depending on the specific application. Prior attempts to integrate membrane filtration with gray water and other wash stream recycle have not succeeded in demonstrating an immediate reuse process. Laundry recycle processes were attempted in the 70's and 80's, however, many of these processes never completed a pilot scale demonstration owing to membrane fouling caused by improper/ill-defined prefiltration, the unavailability of larger lumen hollow fiber membranes, or the use of reverse osmosis (TO) which generally fouls easily and requires higher operating pressures and power requirements compared to ultrafiltration (UF) or microfiltration (MF).

Current gray water recycle/reuse strategies rely on storage of the cleaned water for eventual reuse, or, clean-up of the water to a quality which is unnecessary and essentially "overkill" for a clothes washing process. The above-referenced copending patent application Ser. No. 08/600,460 discloses a process using ultrafiltration or microfiltration whereby gray water can be immediately re-used for further clothes cleaning extraction without storage of the permeate.

The present invention makes use of this improved process in a unique system which washes clothes with no external water connections or drains, and dries the clothes all in the same portable self-contained unit. The operation of the unique system provides a self-cleaning feature to extend the life of the filtration element. No water heater is needed because the user controls whether the load will be warm/hot or cold by filling feed reservoir with warm/hot or cold water.

The present invention also targets smaller clothes washing loads than conventional clothes washers which will benefit persons in dormitories, small apartments, or other remote living quarters. Without washer recycling, the water volume needed would have been impractical in such situations to carry to and from the portable unit.

One object of this invention is therefore to provide a system which uses a minimal amount of water for washing clothes.

Another object of this invention is to provide a self-contained washer/dryer unit which does not require a drain line or water connection or vent.

Yet another object of this invention is to provide an apparatus to wash and dry clothes in a small apartment, dormitory, or other remote location which does not have the convenience of water connections and drain lines.

A still further object of this invention is to provide a process and system utilizing a membrane filtration element which will automatically backflush and clean the membrane at each use, thus eliminating the need to periodically disassemble the system and either replace or clean the filter.

Another object of this invention is to provide a washer and dryer system which uses less water for the wash and rinse cycles than washers not using a membrane recycle system.

Still another object of this invention is to provide a washer/dryer system which reduces energy costs by using hot water feed for the wash cycle and reusing the same hot or warm water for the subsequent rinse, thus eliminating the need to heat the rinse water.

Other objects, advantages and novel features of the present invention will become apparent from the following detailed description when considered in conjunction with the accompanying drawings herein.

BRIEF DESCRIPTION OF THE DRAWING

The sole FIGURE is an overall schematic diagram of one embodiment of the present invention comprised of a combined washer/dryer system.

DETAILED DESCRIPTION OF INVENTION

Figure 1:
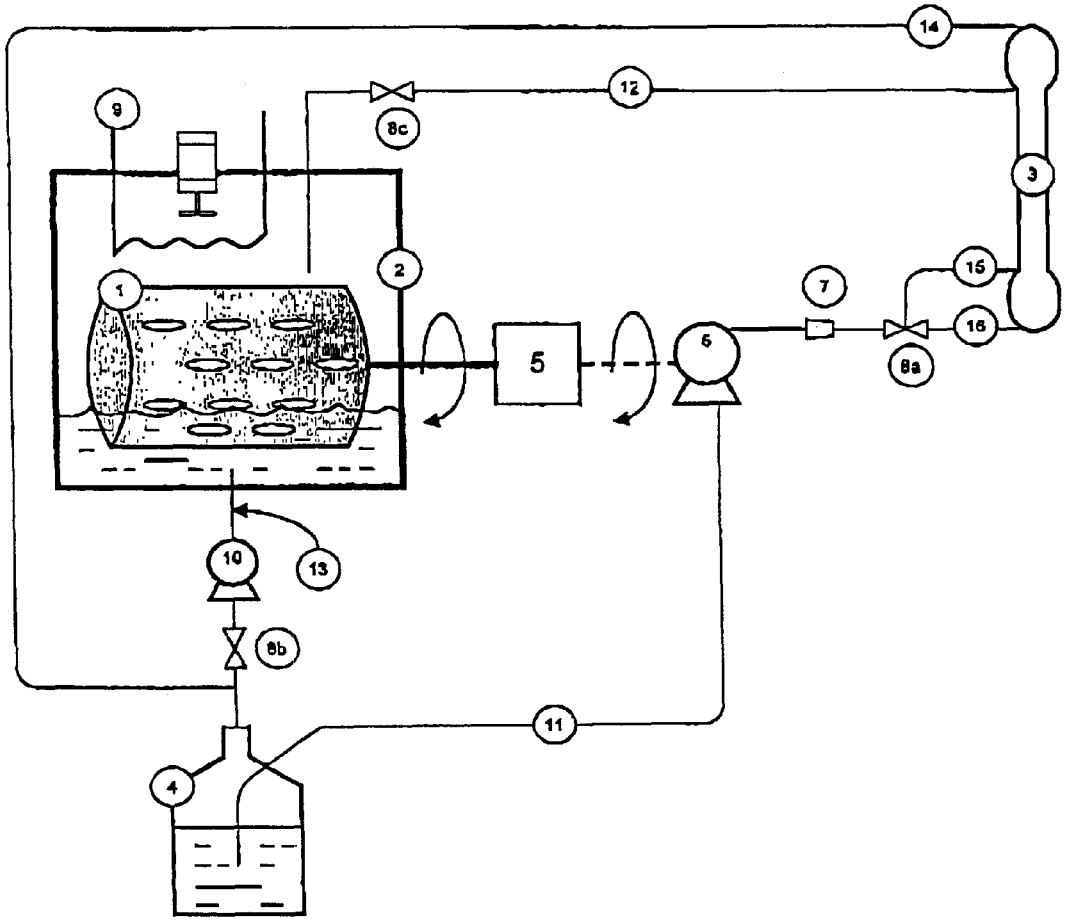

According to a presently preferred embodiment of the present invention, and as depicted in the sole FIGURE, the washer/dryer combination which includes a horizontal-axis, perforated washer basket 1 containing baffles and located inside a larger drum 2; an ultrafiltration or microfiltration membrane filtration element 3; a feed reservoir 4; a washer basket spin motor 5 which can operate the washer basket at at least two speeds, low and high, and the motor can also spin the washer basket in both directions; a pump 6 for circulating water through the filtration element; a prefiltration element 7 located after pump 6 in the illustrated embodiments but other contemplated embodiments can locate this element elsewhere in the system; control valves 8*a*, 8*b*, and 8*c*; a heating assembly 9 comprising a heating element with optional fan or blower; optional pump 10; and other plumbing and fittings which may vary depending on the size and design specific of the system. If pump 6 is connected to the spin motor then valve 8*c* is needed. However, if a separate pump motor is used, valve 8*c* is not necessary.

To carry out this invention, the wash cycle commences by connecting a feed reservoir 4 of fresh water, hot or cold, to the feed line 11 on the system. Because the system does not require a heater for the wash water, a reduction in amperage demand for the unit is achieved. The user will choose whether to select hot or cold water for the wash and rinse by filling the feed reservoir 4 with either hot or cold water from an external water supply (e.g., sink) at the beginning of the wash cycle. The user would also add an appropriate amount of detergent to the feed reservoir or washer basket. After adding dirty clothes to the washer basket, the user would then activate the washer by pressing an "on" button or the like which turns on motor 5 at low speed. The same motor 5 which rotates the washer basket could also be used to power pump 6. Pump 6, powered by the basket spin motor, a separate motor, or the like feeds the water from the feed reservoir 4 through the permeate port line 15 and out line 12 and/or line 14 of a membrane filtration element 3 to backflush the filter element and fill the washer basket. When the reservoir 4 is emptied, the water contained in the feed reservoir has now been moved to the washer basket.

After emptying the feed reservoir 4, the washer basket begins to spin, or tumble, at low speed to agitate the clothes during washing. After a specified period of time, typically 5 to 20 minutes, the wash cycle is completed. The water contents of the washer basket 1 are then transported back to the feed reservoir 4 through the line 13 by the pump 10 or allowed to drain by gravity through the valve 8*b*.

The next step in the clothes washing cycle is the rinsing step. Pump 6 is activated and the water in the feed reservoir is flowed through valve 8*a* to the retentate feed port 16 (and hollow-fiber lumen interior flow path) and out of the membrane cartridge through line 14 back to the feed reservoir 4. The permeate generated while flowing the water from the feed reservoir through the membrane cartridge 3 is then directed through line 12 to the washer basket containing the clothes. A motor, either separate from or the same as the motor powering the pump 6, will also spin the washer basket on high at about 200 to 600 rpm as programmed by the user or the manufacturer.

In one embodiment, the washer basket 1 remains stationary for about 5 to 30 minutes while it accumulates water from the membrane cartridge permeate through line 12. Then, after a preset period of time, the washer basket 1 spins for another 5 to 30 minutes with permeate continuing to be sprayed onto the clothes. A pump 10 can be used to flow the water from the outer drum 2 to the feed reservoir 4, or, the washer basket 1 and outer drum 2 can be situated to gravity drain the water in the outer drum 2 into the feed reservoir 4 through a valve 8*b*. Either valve 8*b* or pump 10 is needed, but not both. The process of rinsing can be carried out in a variety of embodiments consisting of any number or combination of static fills, agitation, or permeate sprays coupled with washer basket spins.

To complete the rinse cycle, valve 8*c* is closed and/or pump 6 is deactivated and the clothes are spun in the washer basket for an additional period of time to remove excess water. This extracted water continues to drain to reservoir 4 through line 13.

Another embodiment of this invention would allow for additional rinse cycles whereby the washer basket 1 is refilled with permeate, agitated, spun, and sprayed with permeate. This process could be repeated one or more times in addition to the single wash and single rinse illustrated above.

After completing the wash and one or more rinse cycles, the clothes are dried using heating element 9 located within the washer cabinet. This heater dries the clothes by using the heating element in forced or natural convection while tumbling at low speed using motor 5. In the preferred embodiment, the heating element would be a resistance heater. Clothes will contain up to about 0.4 lb water or less per lb of dry clothes after the last rinse cycle, and typically after a rinse spin cycle the amount of water remaining on the clothes will be less. For example, assume 0.2 lb water per lb clothes remains after a particular wash and rinse cycle. Therefore, the heater must remove about 1 to 1.5 lbs of water to dry the 5 to 7 lbs of clothes in the washer basket. The heat of vaporization of water is about 1000 BTU/lb, so drying 5 to 7 lbs of clothes will require about 1000 to 1500 BTU or 0.30 to 0.44 kW-hr. The heating element in the washer is sized accordingly to affect drying within a reasonable period of time. For example, to dry the clothes in 45 minutes, the minimum size for a resistance heating element is about 400 to 600 W. Using a 120 VAC circuit means the current draw would be about 5 amps or less which can easily be handles by a typical 15 to 20 amp circuit.

After the drying process is completed, the feed reservoir, which contains the gray water generated during the wash and rinse process can now be removed from the washer system and discarded. The preferred embodiment of the system will include appropriate check valves or other control devices to maintain water in the filtration column 3 at the completion of the wash and rinse cycle.

This invention has particular advantages for use in dormitories, small apartments, or other remote locations which do not have water connections (drain line, water supply) readily available. It is also advantageous with respect to the dryer which does not require any venting lines. In particular, a washer/dryer device which can wash 5 to 7 lbs of clothes would be advantageous because the size of such a unit would be very compact with an approximate 6" to 24", preferably 10" to 12", diameter washer basket. A unit having this size and dimension would also require about 1 to 5 gallons, preferably about 1 to 2 gallons, of water in addition to the water inventory in the filtration element and plumbing. Since 1 to 2 gallons of water weigh about 8 to 16 lbs, the water feed reservoir 4 is permitted to be lightweight and easily managed by even elderly users.

Particular advantages flow from using a cross-flow ultrafiltration element with hollow-fiber lumens and a molecular weight cutoff (MWCO) in the range of 10,000 to 500,0000, the optimum MWCO depending upon the specific construction and matrix of the membrane material. Microfiltration elements having a pore size of about 1 micrometer or less could also be used as the membrane filtration element. The preferred material of construction for the perforated washer basket is stainless steel; however, other materials compatible with bleach, detergent, and temperatures at or above room temperature can also serve the function.

The preferred washer basket orientation would be horizontal, in light of the advantages with regard to water requirements. The washer system would therefore contain a front loading door through which the clothes would be loaded. This door or opening can consist of a hinged, latched door, or a screw-on, or bayonet type lid.

The membrane element of this invention is best maintained by periodically cleaning the system with a dilute bleach solution. This is particularly true for cases where the user does not expect to use the washer for a period of about 1 week or longer. Hence, running an empty wash/rinse cycle with a dilute solution of bleach would be in best practice to clean and also store the system.

The net result of this washer/dryer system is a major reduction in water usage and power consumption. The combination washer/dryer is also a non-venting system so that the water vaporized from the clothes in the dryer can be condensed into the cooler feed reservoir 4 or vented to the room.

In addition to the energy savings, this invention will greatly reduce the burden on water treatment facilities and waste disposal (i.e., energy and resources devoted to water treatment). The water utilization by communities or local groups using these systems will also be greatly diminished since much less water will be required to wash the same weight of clothes. All of these benefits indirectly decrease the energy costs for a community's water treatment facility since LESS water must ultimately be treated and supplied, decreasing the demand on water processing equipment. There will also be energy savings related to lower volumes of water treatment and surfactant (detergent) use. The cost in water usage and disposal incurred by the user will also be reduced.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for washing and drying clothes in an integrated unit, comprising:

placing clothes in a basket;

adding hot or cold water to a self-contained feed reservoir;

pumping said water from said self-contained feed reservoir into said basket;

washing said clothes in said basket, thereby generating graywater;

directing said graywater to said self-contained feed reservoir;

pumping said graywater from said self-contained feed reservoir through a membrane filtration unit, thereby generating permeate and retentate;

directing said retentate to said self-contained feed reservoir;

directing said permeate to said basket and rinsing said clothes with said permeate, thereby generating additional graywater;

directing said additional graywater to said self-contained feed reservoir; and drying said clothes in said basket.

2. The process according to claim 1, wherein the step of pumping the water comprises pumping the water from said feed reservoir through said membrane filtration unit to backflush a filter element in said membrane filtration unit.

3. A process according to claim 1, wherein the membrane filtration unit comprises a microfiltration membrane.

4. A process according to claim 1, wherein the membrane filtration unit comprises an ultrafiltration membrane.

5. A process according to claim 1, wherein said washer and dryer system has no external water connections or drains.

6. A process according to claim 1, wherein said washer and dryer system has no vents.

7. A process according to claim 1, wherein said system is a closed loop and has no direct water feed lines or drains.

* * * * *